US006502340B2

(12) United States Patent
Stone et al.

(10) Patent No.: US 6,502,340 B2
(45) Date of Patent: Jan. 7, 2003

(54) PORTABLE DISPLAY SUPPORT WITH COMBINED STABILIZER AND INSERTION AID

(76) Inventors: M. Steve Stone, P.O. Box 628, Bailey, NC (US) 27807; Tony R. Stone, 2902 Wolf Trap Dr. NW., Wilson, NC (US) 27896

( * ) Notice: Subject to any disclaimer, the term of this patent is extended or adjusted under 35 U.S.C. 154(b) by 0 days.

(21) Appl. No.: 09/838,746

(22) Filed: Apr. 19, 2001

(65) Prior Publication Data

US 2002/0152658 A1 Oct. 24, 2002

(51) Int. Cl.[7] ..... G09F 15/00
(52) U.S. Cl. ..... 40/606; 40/610; 248/156
(58) Field of Search ..... 40/606, 607, 610; 248/156

(56) References Cited

U.S. PATENT DOCUMENTS 2,722,420 A * 11/1955 Adamson ..... 248/156
4,103,445 A * 8/1978 Smith et al. ..... 40/607
4,327,514 A * 5/1982 Bourque ..... 60/607
4,866,866 A * 9/1989 Rotter et al. ..... 40/610
D361,794 S * 8/1995 Oakley ..... D20/10
5,881,495 A * 3/1999 Clark ..... 248/156
5,881,978 A * 3/1999 Rust ..... 248/156
6,009,652 A * 1/2000 Smith ..... 40/610

* cited by examiner

*Primary Examiner*—Cassandra H. Davis
(74) *Attorney, Agent, or Firm*—Glasgow Law Firm, PLLC

(57) ABSTRACT

A portable sign, easily insertable into the ground without the aid of any tools and bilaterally stabile, composed of a display inserted into and upheld by a rectangular frame that includes two spaced apart parallel horizontal bars and two spaced apart parallel vertical bars. The sign also includes two spaced apart depending posts connected to the frame and insertable into the ground, each post has at least one symmetrical stabilizer that also facilitates insertion, thereby allowing a person to easily and quickly insert and stabilize the sign. The combined functions of stabilization and insertion facilitator into one element make the sign of lighter weight and more easily manageable.

18 Claims, 2 Drawing Sheets

PORTABLE DISPLAY SUPPORT WITH COMBINED STABILIZER AND INSERTION AID

BACKGROUND OF THE INVENTION (1) Field of the Invention

The present invention relates generally to display supports and, more particularly, to signs having insertion aids and stabilizers.

(2) Description of the Prior Art

Generally in the relevant art, portable display signs are frequently used to advertise or otherwise notify the public of a particular event or occurrence. These signs are usually inserted into the ground out-of-doors and therefore must withstand adverse weather conditions, such as heavy wind and rain as well as temperature extremes. Given the great use of these signs, a number of inventions have been developed to aid in the insertion of the sign into the ground and to stabilize the sign under adverse conditions.

U.S. Pat. No. 5,921,035 issued to Kempf on Jul. 13, 1999 for Lockable Screw Post Apparatus teaches an anchoring device for anchoring a shaft in relatively hard ground including an elongated shaft having a ground penetration member that requires rotational insertion into the ground. The penetration member includes a coiled extension portion extending longitudinally beyond the shaft lower end to facilitate penetration of the ground when rotated in one direction.

U.S. Pat. No. 5,181,335 issued to Todd on Jan. 26, 1993 for a Portable sign installation kit and method of using same teaches a portable sign mounting arrangement that includes a non-symmetrical, foot peg extending transversely from the mounting standard in one direction to aid in ground insertion.

U.S. Pat. No. 4,516,344 issued to Seely on May 14, 1985 for a Portable wind-resistant sign stand with flexible sign teaches a lightweight, portable sign and stand apparatus having a plurality of ground-engaging legs that contact the ground surface but do not penetrate the ground, and are secured to a longitudinally-extending elongated base assembly in a "y"" format. This sign is not inserted but rests on top of the ground.

Thus, the relevant prior art indicates that it is known to provide ground-insertion as support for signage. Additionally, it is known to use a non-symmetrical, monopedal appendage to aid in insertion. However, such a device does not allow one to easily mount on the signpost with both feet and apply one's weight completely on the signpost. Rather, one must balance on the monopedal appendage on one foot. This can be a precarious position, especially when trying to insert the sign in hard ground. In these cases, the sign inserter frequently bounces on the monopedal on one foot, attempting to insert the sign, and risks slipping off the appendage and hurting himself. Thus, there remains a need for a sign insertion appendage that allows one to easily and safely apply one's full weight and to also easily and safely bounce upon it when necessary.

Additionally, large signs require supporting posts to be inserted deep into the ground. Because the supporting posts need to be of a large diameter in order to increase the surface area onto which lateral forces would be exerted so as not to exceed to the resistance of the ground, large, deep holes need to be dug, thus making installation labor-intensive. In addition, with the increased number of buried utilities, this practice has become dangerous as well. These signs with large signposts are generally heavy and unmanageable. It is known to use extended ground support legs to stabilize a noninserted sign to wind and other lateral forces. However, it is nowhere taught or suggested to use these extended ground support legs with a large sign. Thus, there remains a need for a portable sign support that can support a large sign without the need for deep insertion of the sign's posts.

Moreover, it is nowhere taught to reduce the weight and increase the manageability of the sign by combining into one appendage the functions of bipedal insertion facilitation to aid in ground insertion with sign stabilization by providing symmetrical support on both sides of a sign. Thus, there remains a need for an insertion facilitator that can also function as a stabilizer that increases both the vertical and horizontal stability and outdoor endurance of the sign.

Therefore, it is the scope of this invention to improve on the current art by providing a sign insertion appendage that allows one to easily apply one's full weight to it and to also easily bounce upon it when necessary. In addition, the scope of the invention will also be to improve on the current art by incorporating a sign stabilization function into this insertion appendage by having it provide symmetrical support on both sides of a sign.

A final scope of the invention is to incorporate these two functions into one appendage, such that the weight and manageability of the sign is improved.

SUMMARY OF THE INVENTION

It is an object of the present invention to provide a symmetrical sign insertion appendage that allows a person to easily apply his body weight to the sign using either one or both feet to facilitate the insertion of the sing into the ground.

Another object of the present invention is to provide an improved sign support by providing bilateral sign stabilization such that there is symmetrical support on both sides of a sign.

A final object of the invention is to incorporate these two functions into one element, such that the weight and manageability of the sign is improved.

Accordingly, one aspect of the invention is to provide a symmetrical sign insertion appendage that allows a person to easily apply his body weight to the sign using either one or both feet to facilitate the insertion of the sing into the ground.

Another aspect of the present invention is to provide an improved sign support by providing bilateral sign stabilization such that there is symmetrical support on both sides of a sign.

A final aspect of the invention incorporates these two functions into one element, such that the weight and manageability of the sign is improved.

These and other aspects of the present invention will become apparent to those skilled in the art after a reading of the following description of the preferred embodiment when considered with the drawings.

DETAILED DESCRIPTION OF THE PREFERRED EMBODIMENT

Figure 1:
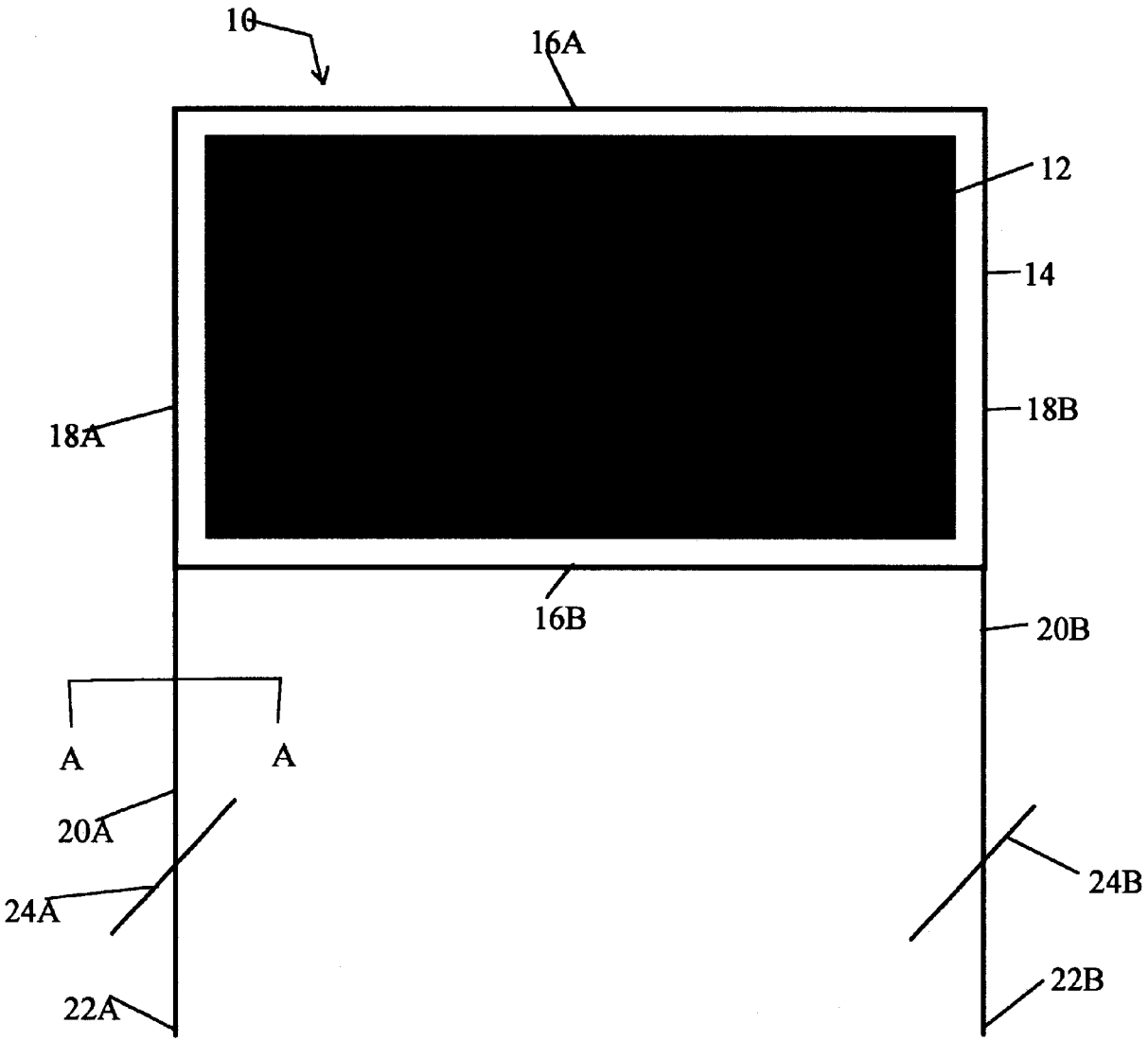
FIG. 1.0—A diagram of a preferred embodiment of the present invention

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

The preferred embodiment of the present invention is a symmetrical sign insertion appendage that allows a person to easily apply his body weight to the sign using either one or both feet to facilitate the insertion of the sing into the ground. The preferred embodiment according to the present invention also provides improved sign support by providing bilateral sign stabilization such that there is symmetrical support on both sides of a sign. Finally, the preferred embodiment according to, the present invention incorporates these two functions into one element, such that the weight and manageability of the sign is improved.

Figure 2:
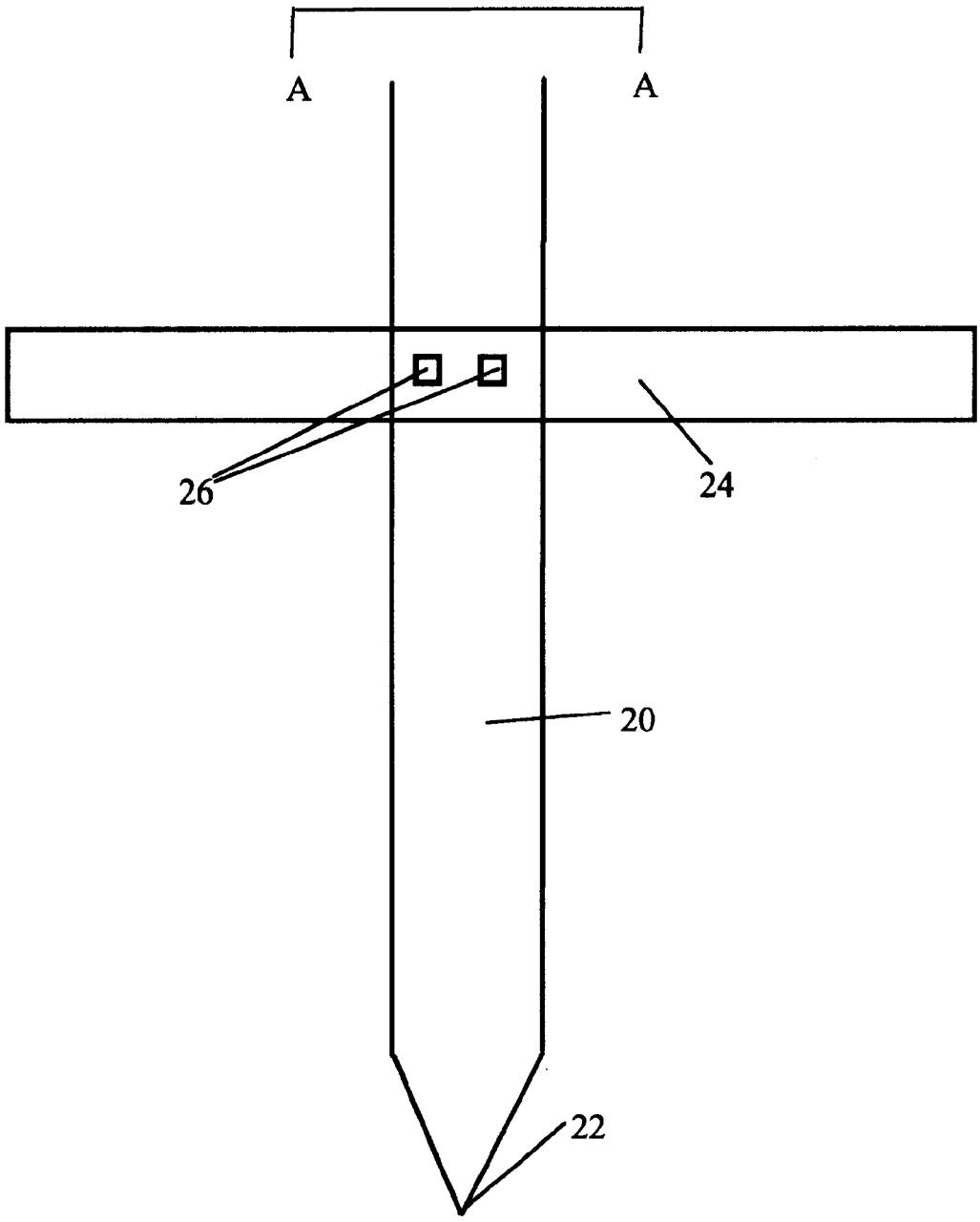
FIG. 2.0—An expanded view of a preferred embodiment of the present invention along section A—A from FIG. 1.

Referring now to the drawings in general, the illustrations are for the purpose of describing a preferred embodiment of the invention and are not intended to limit the invention thereto. As shown in FIG. 1, a portable sign, generally referenced as 10, is insertable into the ground without the aid of any tools and is bilaterally stabile. The sign consists of a planar display 12 inserted into and upheld by a rectangular frame 14. The rectangular frame 14 includes two spaced apart parallel horizontal bars 16A,B and two spaced apart parallel vertical bars 18A,B. These bars may be of angle iron or other suitable metal, like aluminum or steel, or a rigid plastic or composite material, appropriately shaped, such as I-, C-, T- or L-beam, to accept and retain a planar display. Connected to and depending from the frame are two spaced apart posts 20A,B. These posts may be detachable from the frame or may be an extension of the two spaced apart parallel vertical bars 18A,B. In the preferred embodiment, these posts are an extension of the two spaced apart parallel vertical bars. These posts are designed such that they are insertable into the ground. Therefore, they are of sufficient rigidity to penetrate hard ground. Additionally, in the preferred embodiment, the ends of the posts are designed such that they more easily penetrate the ground. For example, the ends may be sharpened or otherwise designed such that they form a pointed end 22, as best shown in FIG. 2. Finally, the posts may be coated with a material or materials, such as Teflon or other lubricant, that are friction reducers and facilitate insertion into the ground.

In the preferred embodiment, each post has at least one symmetrical stabilizer 24A,B that also facilitates insertion, thereby allowing a person to easily and quickly insert and stabilize the sign. These stabilizers 24A,B are affixed orthogonally to the posts 18A,B and orthogonally to the planar display 12. In an alternate embodiment, two stabilizers are affixed to each post, orthogonally to one another. One of these stabilizers may be orthogonal to the sign plane or non-orthogonal to the sign plane. As shown in FIG. 2, the stabilizers 24 are securely affixed to the posts 20, either permanently, such as by welding, or detachably, such as with bolts 26 or other fasteners or fastening means. Detachable stabilizers can facilitate transport of large signs or multiple signs, as the signs are readily stackable without the stabilizers. In addition, detachable stabilizers allow for the stabilizers to be adjustable to various heights along the posts, such that the sign can be erect on irregular terrain.

In the preferred embodiment, the frame is made from materials, such as metals like iron, steel, and/or aluminum, metal alloys, rigid plastics, and/or composites, that are sufficiently strong and durable to support a sign under adverse elements, such as strong wind, heavy rain, and extreme temperatures. In the preferred embodiment, the frame and posts are made from angle iron, which provides both rigid structural material and an L-shape frame for increased rigidity and stiffness. Additionally, the angle iron provides a surface to which the planar display can be affixed.

The planar display may also be made from materials that are sufficiently strong and durable to withstand inclement weather. Examples of such materials are plywood and fluteboard. Fluteboard is a one-piece process extruded sheet consisting of two flat sheets connected by vertical ribs. It is made from polypropylene co-polymer and has physical durability and chemical resistance properties that make it ideal for exterior use. It is available in a large selection of colors, ultra-violet ray stabilized, and in a variety of weights and thicknesses. In the preferred embodiment, the fluteboard is COREX, universally available from American Sign Co. in Wilson, N.C. (252-291-2200). A suitable alternative, although not as lightweight as COREX, is plywood, preferably ¾" thick plywood, that can be painted, printed, or coated.

It is possible to change all or part of the signage portion or planar display 12, in approximately 30 minutes, by using appropriate fastening means to detach and attach the variable portions of the display. For example, placards, preferably COREX placards, can be screwed, bolted, clamped, or affixed by some other appropriate means to the display such that they can be easily changed when necessary.

Certain modifications and improvements will occur to those skilled in the art upon a reading of the foregoing description. By way of example, multiple stabilizers can be added to each post. Also, the dimensions of the frame can be varied such that the planar display is not orthogonal. All modifications and improvements have been deleted herein for the sake of conciseness and readability but are properly within the scope of the following claims.

We claim:

1. A portable sign, insertable into the ground without the aid of any tools and bilaterally stabile, comprising:

a. a planar display inserted into and upheld by a rectangular frame that includes two spaced apart parallel horizontal bars and two spaced apart parallel vertical bars;

b. two spaced apart depending posts connected to the frame and insertable into the ground, wherein each post has at least one symmetrical stabilizer that also facilitates insertion, wherein the at least one symmetrical stabilizer is located at a stabilizing distance from the insertion end of the respective post such that upon insertion of the sign into the ground the at least one stabilizer remains above ground for stabilizing the sign against a surge of the ground, wherein the stabilizing distance is approximately equal to the total length of the stabilizer, thereby allowing a person to easily and quickly insert and stabilize the sign.

2. The sign according to claim 1, wherein the at least one stabilizer is symmetrical about each post and is orthogonal to the planar display.

3. The sign according to claim 1, wherein the at least one stabilizer includes two stabilizers orthogonal to one another and at least one stabilizer is symmetrical about each post and orthogonal to the planar display.

4. The sign according to claim 1, wherein the dependent posts have sharpened ends to facilitate insertion.

5. The sign according to claim 1, wherein the dependent posts have a friction reducer to facilitate entry.

6. The sign according to claim 1, wherein the dependent posts are formed of angle iron.

7. The sign according to claim 1, wherein the planar display is made of fluteboard.

8. The sign according to claim 1, wherein the planar display is made of polypropylene.

9. The sign according to claim 1, wherein the frame, posts, and stabilizers are made of materials selected from the group consisting of iron, steel, aluminum, metal alloys, rigid plastics, composites, and combinations thereof.

10. A portable sign, insertable into the ground without the aid of any tools and bilaterally stabile, comprising:

a. a planar display inserted into and upheld by a rectangular frame that includes two spaced apart parallel horizontal bars and two spaced apart parallel vertical bars;

b. two spaced apart depending posts connected to the frame and insertable into the ground, wherein each post has at least one symmetrical insertion facilitator that also stabilizes, wherein the at least one symmetrical insertion facilitator is located at a distance from the insertion end of the respective post such that, upon insertion of the sign into the ground, the at least one insertion facilitator remains above ground for stabilizing the sign against a surface of the ground, wherein the stabilizing distance is approximately equal to the total length of the insertion facilitator, thereby allowing a person to easily and quickly insert and stabilize the sign.

11. The sign according to claim 10, wherein the at least one insertion facilitator is symmetrical about each post and is orthogonal to the planar display.

12. The sign according to claim 10, wherein the at least one insertion facilitator includes two insertion facilitators orthogonal to one another and at least one insertion facilitator is symmetrical about each post and orthogonal to the planar display.

13. The sign according to claim 10, wherein the dependent posts have sharpened ends to facilitate insertion.

14. The sign according to claim 10, wherein the dependent posts have a friction reducer to facilitate entry.

15. The sign according to claim 10, wherein the dependent posts are formed of angle iron.

16. The sign according to claim 10, wherein the planar display is made of fluteboard.

17. The sign according to claim 10, wherein the planar display is made of polypropylene.

18. The sign according to claim 10, wherein the frame, posts, and stabilizers are made of materials selected from the group consisting of iron, steel, aluminum, metal alloys, rigid plastics, composites, and combinations thereof.

* * * * *